US006910463B2

(12) United States Patent
Oshizawa et al.

(10) Patent No.: US 6,910,463 B2
(45) Date of Patent: Jun. 28, 2005

(54) FUEL INJECTION DEVICE

(75) Inventors: Hidekazu Oshizawa, Higashimatsuyama (JP); Yoriyuki Takekawa, Higashimatsuyama (JP)

(73) Assignee: Bosch Automotive Systems Corporation (JP)

( * ) Notice: Subject to any disclaimer, the term of this patent is extended or adjusted under 35 U.S.C. 154(b) by 240 days.

(21) Appl. No.: 10/276,559

(22) PCT Filed: May 15, 2001

(86) PCT No.: PCT/JP01/04037

§ 371 (c)(1),
(2), (4) Date: Jan. 7, 2003

(87) PCT Pub. No.: WO01/88364

PCT Pub. Date: Nov. 22, 2001

(65) Prior Publication Data

US 2004/0069872 A1 Apr. 15, 2004

(30) Foreign Application Priority Data

May 17, 2000 (JP) ..... 2000-144683

(51) Int. Cl.[7] ..... F02M 47/02; F02M 51/00
(52) U.S. Cl. ..... 123/446; 123/447; 123/467
(58) Field of Search ..... 123/446, 447, 123/456, 467, 510, 299, 300

(56) References Cited

U.S. PATENT DOCUMENTS 4,459,959 A * 7/1984 Terada et al. ..... 123/446
5,622,152 A * 4/1997 Ishida ..... 123/446
5,697,342 A * 12/1997 Anderson et al. ..... 123/446
5,875,764 A * 3/1999 Kappel et al. ..... 123/467
6,345,605 B1 * 2/2002 Augustin et al. ..... 123/446
6,446,603 B1 * 9/2002 Bonse et al. ..... 123/446

FOREIGN PATENT DOCUMENTS

| | | |
|---|---|---|
| DE | 19910970 | 9/2000 |
| DE | 19939429 | 3/2001 |
| DE | 10101358 | 7/2002 |
| JP | 64-000352 | 1/1989 |
| JP | 08-021332 | 1/1996 |

* cited by examiner

*Primary Examiner*—Weilun Lo
(74) *Attorney, Agent, or Firm*—Connolly, Bove, Lodge & Hutz LLP

(57) ABSTRACT

A check valve (8) and a booster (9) are inserted in parallel in a supplied fuel line (6) connecting a common rail (5) and an injection valve (7), a piston (10E) of a hydraulic circuit (10) is driven for positioning by a piezoelectric actuator (PA-1), the pressures in a chamber (9Db) of the booster (9) and the pressure in a fuel chamber (7G) of the injection valve (7) are selectively lowered by controlling the alignment state between ports (10Eb), (10Ec) provided in the piston (10E) to communicate with a low-pressure portion and an opening 10Aa of a first chamber 10A and an opening (10Ba) of a second chamber (10B) of cylinder (10C), whereby the pressure of the fuel supplied to the fuel reservoir (7B) of the injection valve (7) is rapidly switched to one or the other of high-pressure fuel from the common rail (5) and pressure-boosted high-pressure fuel from the booster (9).

13 Claims, 3 Drawing Sheets

FUEL INJECTION DEVICE

TECHNICAL FIELD

The present invention relates to a fuel injection system configured to inject high-pressure fuel accumulated in a common rail into the cylinders of an internal combustion engine using fuel injection valves.

BACKGROUND ART

Recent years have seen wide adoption of common rail type fuel injection systems that are equipped with a common rail for accumulating high-pressure fuel supplied under pressure from a high-pressure pump and are constructed to inject the high-pressure fuel in the common rail into the cylinders of an internal combustion engine through corresponding fuel injection valves at electronically controlled injection timing. For realizing good operating characteristics in this type of fuel injection system, it is preferable, for example, to set the common rail pressure relatively low during idling so as to reduce noise and achieve smooth rotation and to set the common rail pressure somewhat high during low-load operation so as to prevent degradation of fuel efficiency. Further, the common rail pressure is preferably set as high as possible during high-load operation so as to reduce occurrence of black smoke and particulates (PM).

Power deficiency, black smoke and other problems therefore arise if the high-pressure fuel in the common rail is merely supplied to the fuel injection valves as it is over the whole operating range. For overcoming these problems, Japanese Patent Application Public Disclosure No. Hei 8-21332 discloses a common rail type fuel injection system in which a booster piston is provided for increasing the pressure of the high-pressure fuel supplied to the common rail and a controller switches between high-pressure injection with the booster piston operative and low-pressure injection corresponding to the inoperative state of the booster piston.

However, since the disclosed system is structured to selectively supply the fuel injection valves with high-pressure fuel from the common rail or pressure-boosted high-pressure fuel from the booster piston by switching control using two solenoid valves, increased cost cannot be avoided because two sets of solenoid valves and associated drive circuits are required. In addition, the two solenoid valves need to be driven in a required synchronous relationship. In view of the scatter in solenoid valve response characteristics and variation in solenoid valve characteristics with temperature change, however, the required switching characteristic is difficult to achieve over the whole range of use temperatures. Use of a complex and expensive control circuit is therefore unavoidable, so that a problem of high cost also arises from this aspect.

One object of the present invention is to provide a fuel injection system capable of overcoming the foregoing problems of the prior art.

Another object of the present invention is to provide a fuel injection system capable of varying the pressure of fuel supplied to fuel injection valves very rapidly using a simple structure.

Another object of the present invention is to provide a fuel injection system enabling size reduction of a control circuit for high-speed switching the pressure of fuel supplied to fuel injection valves.

Another object of the present invention is to provide a fuel injection system capable of minimizing the level of electrical noise energy output from a driver when the pressure of fuel supplied to fuel injection valves is varied.

DISCLOSURE OF THE INVENTION

The fuel injection system according to the present invention comprises: a common rail for accumulating high-pressure fuel pressurized by a high-pressure pump; a fuel injection valve equipped with a needle valve, an injection fuel reservoir, and a fuel chamber for imparting backpressure to the needle valve; a supplied fuel line communicating the injection fuel reservoir and the common rail; a booster installed in the supplied fuel line to be capable of boosting the pressure of the high-pressure fuel and sending it to the injection fuel reservoir as pressure-boosted high-pressure fuel; and a switching unit for fuel switching that is equipped with an electric actuator and conducts switching to select one or the other of the high-pressure fuel from the common rail and the pressure-boosted high-pressure fuel from the booster as the fuel sent to the injection fuel reservoir.

The switching unit can be configured to include a switching valve driven by the electric actuator, which switching valve conducts the fuel pressure switching by communicating the fuel chamber and/or a booster piston chamber of the booster with a low-pressure portion. The switching valve can be configured to have a first chamber in communication with the booster piston chamber and a second chamber in communication with the fuel chamber and to conduct the fuel pressure switching by operating the electric actuator to cause the first chamber and/or the second chamber to come into communication with ports formed in a valve body for positioning control that communicate with a low-pressure portion.

The switching valve can be configured to comprise: a piston formed with first and second ports communicating with a low-pressure portion and driven for positioning by the electric actuator; and a cylinder accommodating the piston and formed with a first chamber communicating with the booster piston chamber and a second chamber communicating with the fuel chamber, the electric actuator being adapted to selectively position the piston at one of a first position where the first and second ports are not in communication with either the first or second chambers, a second position where only the first port is in communication with the second chamber, and a third position where the first port is in communication with the second chamber and the second port is simultaneously in communication with the first chamber.

The fuel injection system of the present invention, further comprises in the fuel injection system configured as described in the foregoing a control circuit for driving the electric actuator, the control circuit being fabricated on a printed circuit board having at least three layers and high-voltage side wiring of a high-voltage section of the circuit for driving the electric actuator being constituted using an inner layer of the printed circuit board. The printed circuit board can be given a configuration that is segmented into a first region where the control circuit is fabricated and a second region where circuits other than the control circuit are fabricated.

The printed circuit board can be configured to have at least four layers and to also constitute the wiring of the ground side of the high-voltage section using an inner layer of the printed circuit board. The wiring of the ground side can be made solid wiring to reduce unnecessary radiation.

The fuel injection system according to the present invention is equipped with a booster for boosting the pressure of high-pressure fuel from a common rail so as to enable supply of pressure-boosted high-pressure fuel in addition to high-pressure fuel, and an electric actuator conducts switching to select one or the other of the high-pressure fuel and the pressure-boosted high-pressure fuel as the fuel supplied to the fuel injection valve. If a piezoelectric actuator is used, the switching can be conducted at very high speed. Moreover, unlike the conventional practice of controlling the driving of two solenoid valves to maintain required cycles, fuel pressure switching can be conducted instantaneously in switching valve fashion by a single electric actuator. This eliminates the need to take actuator characteristic variance and temperature characteristics into consideration, simplifies the configuration of the electrical circuitry for drive control, and enables a cost reduction.

Further, since a multilayer printed circuit board is used to fabricate the control circuit for the electric actuator (e.g., a piezoelectric actuator) so that the wiring of the high-voltage side of the high-voltage section is constituted using an inner layer, insulation breakdown is unlikely even if the voltage of a high-voltage power supply is applied to the electric actuator under high switching speed because the inner layer is coated with an insulating material and therefore has a high withstand voltage. This makes it possible to reduce size by implementing high-density wiring, so that a high packing density can be realized despite the use of a high voltage. While the driving voltage must be set high to realize high speed, this need can be met owing to the excellent insulation performance, so that high-speed driving by application of a high voltage becomes possible to thereby realize fuel injection that is both accurate and fast.

In addition, effective suppression of noise signal occurrence is enabled by using an inner layer to form the wiring of the ground circuits as solid wiring and thereby minimize the level of unnecessary radiation from the printed circuit board

BEST MODE OF CARRYING OUT THE INVENTION

A preferred embodiment of the present invention will now be explained in detail with reference to the drawings.

Figure 1:
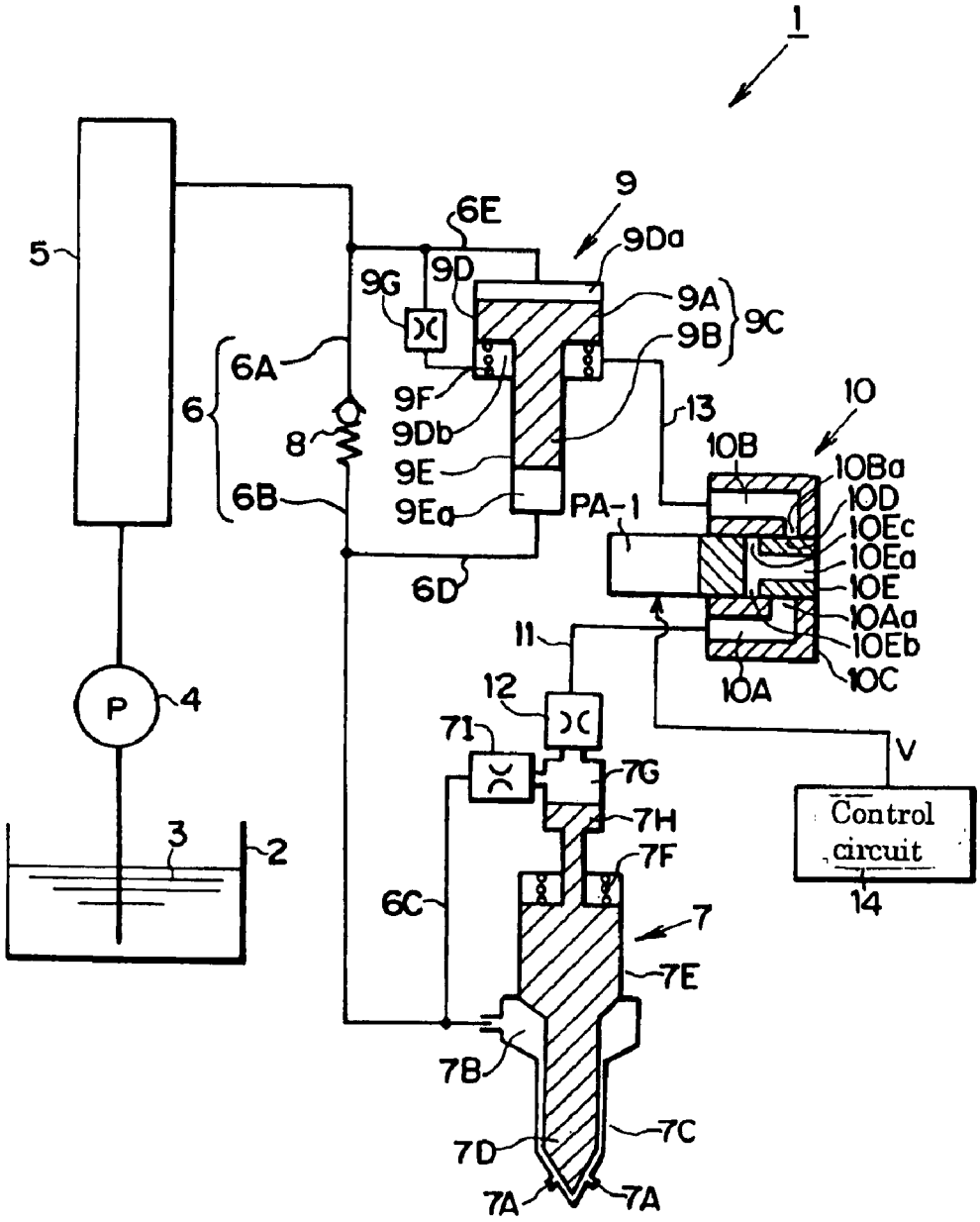
FIG. 1 is a configuration diagram showing a fuel injection system that is one embodiment of the present invention.

FIG. 1 is a configuration diagram showing an embodiment of the fuel injection system according to the present invention. The fuel injection system 1 is a common rail type fuel injection system for injecting fuel in an internal combustion engine (not shown) used to drive a vehicle. It is configured to pressurize fuel 3 from a fuel tank 2 with a high-pressure pump 4, accumulate the pressurized fuel in a common rail 5, and supply the high-pressure fuel accumulated in the common rail 5 through a supplied fuel line 6 composed of fuel lines 6A, 6B to a fuel injection valve 7 explained later.

The fuel injection valve 7 is installed in one cylinder among multiple cylinders of the unshown internal combustion engine. The injection valve 7 directly injects high-pressure fuel into the cylinder. Although FIG. 1 shows only one injection valve 7, a number of injection valves 7 equal to the number internal combustion engine cylinders are provided one per cylinder.

The basic structure of the injection valve 7 is well known. The injection valve 7 has a nozzle 7C formed at its tip with multiple nozzle holes 7A for injecting fuel and with a fuel reservoir 7B for storing fuel to be supplied to the nozzle holes 7A. A needle valve 7D for controlling communication between the fuel reservoir 7B and the nozzle holes 7A is slidably accommodated in the nozzle 7C. The needle valve 7D is normally energized in the closing direction by a spring 7F housed in a nozzle holder 7E. A fuel chamber 7G is formed in the nozzle holder 7E. A hydraulic piston 7H is slidably inserted into the fuel chamber 7G to be coaxial with the needle valve 7D. The fuel chamber 7G is connected through an orifice 7I and a fuel line 6C to the fuel reservoir 7B, which is connected to the fuel line 6B.

As a result, backpressure commensurate with the fuel pressure can be imparted to the needle valve 7D by supplying high-pressure fuel to the fuel chamber 7G, and the needle valve 7D can be pressed toward the nozzle holes 7A by this backpressure.

A check valve 8 is installed in the supplied fuel line 6 as illustrated. Specifically, the check valve 8 is installed between the fuel lines 6A, 6B, so that supply of the high-pressure fuel in the common rail 5 through the supplied fuel line 6 toward the fuel reservoir 7B is allowed but reverse flow of fuel through the supplied fuel line 6 from the fuel reservoir 7B side to the common rail 5 side is not allowed.

A booster 9 is connected in parallel with the check valve 8 so that the pressure of the high-pressure fuel from the common rail 5 can be boosted and the pressure-boosted high-pressure fuel of still higher pressure be supplied to the fuel reservoir 7B. The booster 9 comprises booster piston 9C composed of a large-diameter piston 9A and small-diameter piston 9B formed as one body, a large-diameter cylinder 9D into which the large-diameter piston 9A is inserted, a small-diameter cylinder 9E into which the small-diameter piston 9B is inserted, and a piston return spring 9F. A booster chamber 9Ea of the small-diameter cylinder 9E communicates with the fuel reservoir 7B through a fuel line 6D, and a chamber 9Da of the large-diameter cylinder 9D communicates with the common rail 5 through a fuel line 6E, thereby connecting the booster 9 in parallel with the check valve 8. Another chamber 9Db of the large-diameter cylinder 9D is connected to the chamber 9Da through an orifice 9G. Owing to the foregoing structure of the booster 9, high-pressure fuel boosted pressure in proportion to the area ratio between the large-diameter piston 9A and the small-diameter piston 9B can be output from the booster chamber 9Ea of the small-diameter cylinder 9E.

Since the check valve 8 and the booster 9 are connected in parallel in the foregoing manner, when the booster 9 operates to discharge pressure-boosted high-pressure fuel from the booster chamber 9Ea, the check valve 8 is in a closed state because the fuel reservoir 7B side of the check valve 8 is at higher pressure than the common rail 5 fuel side thereof and, therefore, the pressure-boosted high-pressure fuel from the booster 9 is supplied to the fuel reservoir 7B instead of high-pressure fuel from the common rail 5. On the other hand, when the booster 9 does not operate and the pressure in the booster chamber 9Ea is lower than the pressure of the high-pressure fuel in the common rail 5, the check valve 8 assumes the open state and the high-pressure fuel in the common rail 5 flows through the check valve 8 and is supplied to the fuel reservoir 7B.

Reference numeral 10 designates a hydraulic circuit for fuel switching that conducts fuel pressure switching to select one or the other of the high-pressure fuel from the common rail 5 and the pressure-boosted high-pressure fuel from the booster 9 as the fuel sent to the fuel reservoir 7B of the injection valve 7.

The hydraulic circuit 10 includes a switching valve composed of a cylinder 10C, which is formed with a first chamber 10A connected to the fuel chamber 7G through a fuel line 11 and an orifice 12 and a second chamber 10B connected to the chamber 9Db through a fuel line 13, and a piston 10E operably provided in a piston accommodating hole 10D of the cylinder 10C. The piston 10E is connected to a piezoelectric actuator PA-1 that drives the piston 10E to position it axially in the piston accommodating hole 10D.

The piston 10E is formed internally in its axial direction with an escape passage 10Ea that communicates with a low-pressure portion. A pair of ports 10Eb, 10Ec are formed in communication with the escape passage 10Ea.

On the other hand, the first chamber 10A is formed with an opening 10Aa looking into the piston accommodating hole 10D, and the second chamber 10B is formed with an opening 10Ba looking into the piston accommodating hole 10D. The positions at which the openings 10Aa, 10Ba are formed are offset in the axial direction of the cylinder 10C, whereby the piston 10E can take any of a first position where the openings 10Aa, 10Ba are simultaneously blocked (the position shown in FIG. 1), a second position where only the opening 10Aa is communicated with the escape passage 10Ea, and a third position where the openings 10Aa, 10Ba are simultaneously communicated with the escape passage 10Ea.

The piezoelectric actuator PA-1 is an actuator for positioning the piston 10E at one of the first to third positions. The piezoelectric actuator PA-1 is constituted so that its axial length varies with very high responsivity to the voltage applied thereto. The piezoelectric actuator PA-1 positions the piston 10E in response to an applied control voltage signal V from a control circuit 14.

The operation of the fuel injection system 1 will now be explained. When the piston 10E, which works like the valve body of a switching valve, is in the first position, no pressure difference acts on the large-diameter piston 9A because the pressure in the chamber 9Db of the booster 9 does not escape through the hydraulic circuit 10 while, owing to the presence of the orifice 9G, the pressures of the chamber 9Da and the chamber 9Db both become the same as the pressure of the high-pressure fuel. The booster 9 therefore does not operate to boost the pressure of the high-pressure fuel. On the other hand, the pressure in the fuel chamber 7G of the injection valve 7 also does not escape through the hydraulic circuit 10 at this time, so that the pressures of the fuel reservoir 7B and the fuel chamber 7G become equal owing to the presence of the orifice 7I. As a result, the injection valve 7 is maintained in the closed state by the force of the spring 7F.

When the piston 10E is switched from the first position to the second position, the port 10Eb communicates with the first chamber 10A so that the pressure in the fuel chamber 7G escapes to the low pressure side through the orifice 12. The backpressure that was acting on the hydraulic piston 7H is therefore removed. Since high-pressure fuel from the common rail 5 is supplied to the fuel reservoir 7B of the injection valve 7 through the check valve 8, the pressure in the fuel reservoir 7B becomes higher than the pressure in the fuel chamber 7G to lift the needle valve 7D and inject high-pressure fuel into the cylinder through the nozzle holes 7A.

When the piston 10E is switched from the second position to the third position, the port 10Ec communicates with the second chamber 10B, while, at the same time, the port 10Eb remains in communication with the first chamber 10B. Therefore, in addition to the fuel chamber 7G, the chamber 9Db is also put in communication with the low-pressure portion through the hydraulic circuit 10.

As a result, the pressure in the chamber 9Db decreases to produce a difference between the pressures acting on the opposite surfaces of the large-diameter piston 9A, thereby putting the booster 9 in the operative state. Accordingly, the pressure of the high-pressure fuel is boosted in the booster chamber 9Ea and the so-obtained pressure-boosted high-pressure fuel is sent to the fuel reservoir 7B of the injection valve 7 to inject pressure-boosted high-pressure fuel into the associated cylinder through the nozzle holes 7A.

Thus, when the piezoelectric actuator PA-1 operates in response to the control voltage signal V to position the piston 10E at the first, second and third positions, there are respectively established an injection halted mode, a high-pressure fuel injection mode and a pressure-boosted high-pressure fuel injection mode.

Therefore, simply by suitably controlling the value of the control voltage signal V the control circuit 14 supplies to the piezoelectric actuator PA-1 to thereby control the positioning of the piston 10E, it becomes possible not only to ON/OFF control injection of high-pressure fuel or pressure-boosted high-pressure fuel but also to switch among the injection halted mode, high-pressure fuel injection mode and pressure-boosted high-pressure fuel injection mode, appropriately and with very high responsivity. As a result, it becomes possible, for instance, to switch from the pressure-boosted high-pressure fuel injection mode to the high-pressure fuel injection mode in accordance with the operating state of the internal combustion engine simply by changing the voltage level of the control voltage signal V. Since, unlike conventionally, no control for synchronizing two solenoid valves or other such complex control is necessary, a simple control circuit suffices, while markedly improved control performance can be achieved on top of a potential reduction in cost.

Figure 2:
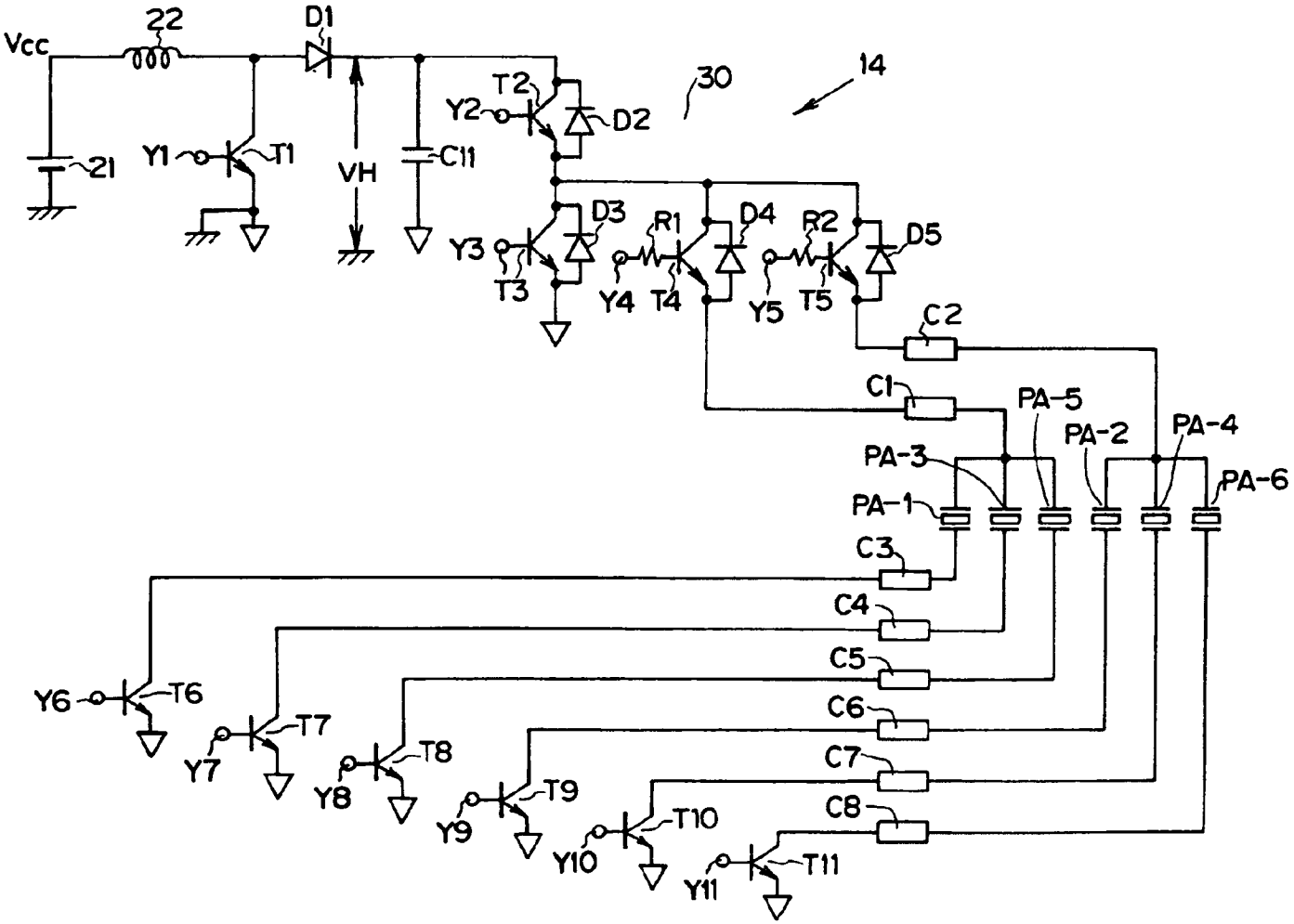
FIG. 2 is a circuit diagram showing a specific example of a control circuit for controlling the injection operation of fuel injection valves of the fuel injection system shown in FIG. 1.

FIG. 2 shows an example of a concrete circuit configuration of the control circuit 14 for controlling the injection operation of the injection valves 7 of the fuel injection system 1 shown in FIG. 1. As pointed out earlier, FIG. 1 shows only one injection valve 7 together with the booster 9 and hydraulic circuit 10 provided in association therewith. Actually, however, not just one but multiple sets each composed of an injection valve 7, booster 9 and hydraulic circuit 10 are provided in a number equal to the number of cylinders of the internal combustion engine. An example is shown here in which there are six cylinders. Since six sets of the fuel injection valve, booster and hydraulic circuit are therefore provided, the control circuit 14 is configured to control the driving of not only the piezoelectric actuator PA-1 but also the piezoelectric actuators PA-2–PA-6 for the other five sets not shown in FIG. 1. "Piezoelectric actuator PA-i" is defined here to signify the piezoelectric actuator associated with the fuel injection valve provided in the ith cylinder. The piezoelectric actuators PA-1, PA-3 and PA-5 have their one ends connected in common to a connector C1, and the piezoelectric actuators PA-2, PA-4 and PA-6 have their one ends connected in common to a connector C2. The piezoelectric actuators PA-1–PA-6 have their other ends connected to connectors C3–C8, respectively.

Reference numeral 21 designates a low-voltage DC power supply of the control circuit 14. The output voltage Vcc of the power supply 21 is boosted by a booster circuit composed of a coil 22, a switching transistor T1 and a diode D1. The high-voltage VH of around 250 V produced by the booster circuit charges a capacitor C11. A high-voltage section 30 supplied with the high-voltage VH is composed of switching transistors T2–T5, diodes D2–D5 and resistors R1 and R2, connected in the illustrated manner. The high-voltage VH charge of the capacitor C11 is supplied through the switching transistor T2 to the switching transistor T4 and the switching transistor T5.

The switching transistor T4 is connected through the connector C1 to the one end of each piezoelectric actuator PA-1, PA-3 and PA-5. The switching transistor T5 is connected through the connector C2 to the one end of each piezoelectric actuator PA-2, PA-4 and PA-6. When the switching transistor T2 is ON, therefore, the high-voltage VH can be applied to the one ends of the piezoelectric actuators PA-1, PA-3 and PA-5 by turning on the switching transistor T4. Similarly, the high-voltage VH can be applied to the one ends of the piezoelectric actuators PA-2, PA-4 and PA-6 by turning on the switching transistor T5.

The other ends of the piezoelectric actuators PA-1–PA-6 are connected through the connectors C3–C8 to switching transistors T6–T11 as illustrated. The other ends of the piezoelectric actuators can be put at ground potential by selectively turning on the associated one of the switching transistors T6–T11.

Owing to the aforesaid configuration of the control circuit 14, the high-voltage VH can be applied to the piezoelectric actuator PA-1, for example, by simultaneously turning on the switching transistor T4 and the switching transistor T6 when the switching transistor T2 is ON. At this time, the switching transistor T2 is not maintained continuously ON but a pulse voltage set to an appropriate duty ratio is applied to the base of the switching transistor T2 to duty-control the ON operation of the switching transistor T2, thereby enabling the voltage level applied to the piezoelectric actuator PA-1 to be set to ½ the level of the high-voltage VH. In other words, by appropriately controlling the conductive states of the switching transistor T2 and the switching transistors T4–T11, the target piezoelectric actuator can be put in any of three states: application of no voltage, application of voltage at ½ the level of high-voltage VH, and application of high-voltage VH. In the present configuration, application of no voltage establishes the injection halted mode, application of voltage at ½ the level of high-voltage VH establishes the high-pressure fuel injection mode, and application of high-voltage VH establishes the pressure-boosted high-pressure fuel injection mode. This mode switching can be performed by applying control pulse signals from an unshown circuit to control signal input terminals Y2 and Y4–Y11 of the switching transistors T2 and T4–T11. The emitter circuit of the switching transistor T1, the grounded side of the capacitor C11 and the emitter circuit of the switching transistor T3 are at ground side potential.

Owing to the foregoing configuration of the control circuit 14, the voltage applied to the piezoelectric actuators PA-1–PA-6 can be controlled to VH or VH/2 by controlling the duty of the switching transistor T2. In addition, the pistons associated with the piezoelectric actuators PA-1–PA-6 can be position at the first, second and third positions by selectively ON/OFF controlling the switching transistor T3–T11. The charge released from the switching transistors T6–T11 when they are opened is discharged to the exterior by dosing the switching transistor T3, thereby enhancing the responsivity of the piezoelectric actuators.

Figure 3:
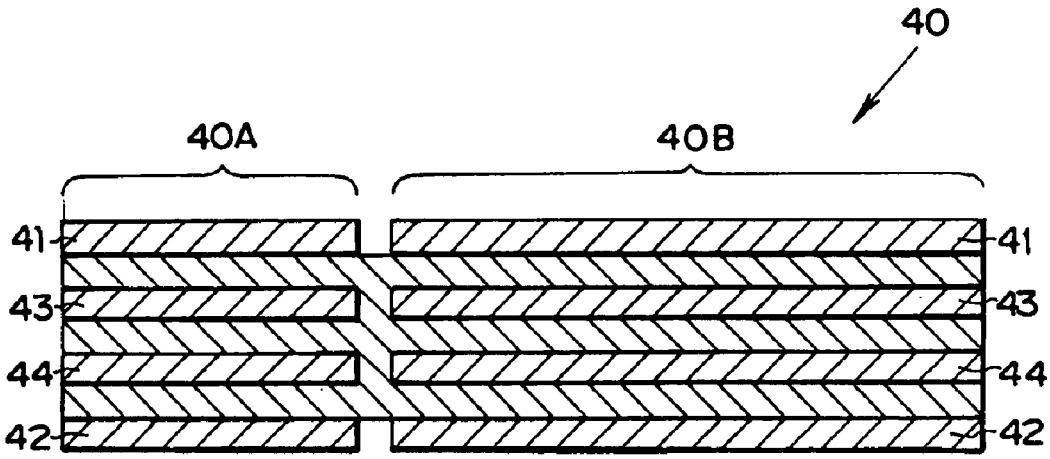
FIG. 3 is a sectional view of multilayer circuit board for mounting the control circuit shown in FIG. 1.

The control circuit 14 of the circuit configuration shown in FIG. 2 is fabricated on a four-layer printed circuit board 40 formed, as shown in FIG. 3, of two outer layers 41, 42 and two inner layers 43, 44. The drive control circuit 14 is fabricated on a first region 40A of the printed circuit board 40 and the circuits other than the control circuit 14, i.e., the circuits other than that for controlling the driving of the piezoelectric actuators, such as the circuit for computing the opening and closing timing of the fuel injection valves, are fabricated on a second region 40B.

In the first region 40A, the inner layer 43 is used to constitute the high-voltage wiring portions from the wiring portions connecting the coil 22 and diode D1 up to the connectors C1, C2, and the wiring for the ground side of this high-voltage wiring portion is constituted by the inner layer 44. The remaining outer layers 41, 42 are used for the other wiring.

In the second region 40B, on the other hand, the inner layer 43 is used for high-voltage side wiring of the other circuits, and the inner layer 44 is used for the ground circuit wiring of the other circuits. The outer layers 41, 42 are used for the other wiring of the other circuits. In the present embodiment, effective suppression of noise signal occurrence is enabled by using the inner layer 44 to form the wiring of the ground circuits as solid wiring so as to minimize the level of unnecessary radiation from the printed circuit board 40. It is noted, however, that the wiring of ground circuits does not necessarily have to be the inner layer 44 and it is possible to use the outer layer 41 or 42 instead.

In the control circuit 14 wired using the printed circuit board 40 in the foregoing manner, since the inner layer 43 is coated with an insulating material and therefore has a high withstand voltage, insulation breakdown is unlikely to occur even if a power supply 21 of a high voltage of, for example, around 250 V is used and this voltage is applied to the piezoelectric actuators under high-speed switching. This makes it possible to reduce size by implementing high-density wiring, so that a high packing density can be realized despite the use of a high voltage. While the driving voltage must be set high to realize high speed, this need can be met owing to the excellent insulation performance described above, so that high-speed driving by application of a high voltage becomes possible to thereby realize fuel injection that is both accurate and fast.

INDUSTRIAL APPLICABILITY

As set out in the foregoing, the fuel injection system according to the present invention is useful for improving the operating characteristics of an internal combustion engine for driving a vehicle or other apparatus when fuel is supplied to the cylinders of the engine by direct injection.

What is claimed is:

1. A fuel injection system comprising:

a common rail for accumulating high-pressure fuel pressurized by a high-pressure pump;

a fuel injection valve equipped with a needle valve, an injection fuel reservoir, and a fuel chamber for imparting backpressure to the needle valve;

a supplied fuel line communicating the injection fuel reservoir and the common rail;

a booster installed in the supplied fuel line to be capable of boosting the pressure of the high-pressure fuel and sending it to the injection fuel reservoir as pressure-boosted high-pressure fuel; and a switching unit for fuel pressure switching that is equipped with an electric actuator and conducts switching to select one or the other of the high-pressure fuel from the common rail and the pressure-boosted high-pressure fuel from the booster as the fuel sent to the injection fuel reservoir and for releasing backpressure from said needle valve.

2. A fuel injection system as claimed in claim 1, wherein the switching unit includes a switching valve driven by the electric actuator and the switching valve conducts the fuel pressure switching by communicating the fuel chamber and/or a booster piston chamber of the booster with a low-pressure portion.

3. A fuel injection system as claimed in claim 2, wherein the switching valve has a first chamber in communication with the booster piston chamber and a second chamber in communication with the fuel chamber and the fuel pressure switching is conducted by operating the electric actuator to cause the first chamber and/or the second chamber to come into communication with ports formed in a valve body for positioning control that communicate with a low-pressure portion.

4. A fuel injection system as claimed in claim 3, wherein the switching valve comprises:

a piston formed with first and second ports communicating with a low-pressure portion and driven for positioning by the electric actuator; and a cylinder accommodating the piston and formed with a first chamber communicating with the booster piston chamber and a second chamber communicating with the fuel chamber, the electric actuator being adapted to selectively position the piston at one of a first position where the first and second ports are not in communication with either the first or second chambers, a second position where only the first port is in communication with the second chamber, and a third position where the first port is in communication with the first chamber.

5. A fuel injection system as claimed in claim 1, further comprising a check valve provided in parallel with the booster for preventing fuel in the supplied fuel line from flowing from the injection fuel reservoir toward the common rail.

6. A fuel injection system as claimed in any of claim 1, wherein the electric actuator is a piezoelectric actuator.

7. A fuel injection system as claimed in claim 2, wherein the electric actuator is a piezoelectric actuator.

8. A fuel injection system as claimed in claim 3, wherein the electric actuator is a piezoelectric actuator.

9. A fuel injection system as claimed in claim 4, wherein the electric actuator is a piezoelectric actuator.

10. A fuel injection system comprising:

a common rail for accumulating high pressure field pressurized by a high pressure pump;

a fuel injection valve equipped with a needle valve, an injection fuel reservoir and a fuel chamber for imparting a back pressure to the needle valve;

a common fuel line connecting said common rail to said injection fuel reservoir;

a booster connected to the fuel line for boosting pressure of the high pressure fuel and supplying a boosted high pressure fuel; and an electrically operated switching valve unit connected to said fuel chamber and booster, said switching valve unit having three states of operation, said switching valve unit isolating said fuel chamber and booster from a source of low pressure in a first state, connecting said fuel chamber to a source of low pressure in a second state of operation whereby said fuel injection valve operates, and connecting said booster to a source of low pressure in a third state of operation, whereby said booster operates in said third state to supply said boosted high pressure fuel to said injection fuel reservoir.

11. The fuel injection system according to claim 10, wherein said switching valve unit maintains said fuel injection valve fuel chamber connected to said source of low pressure during said third state.

12. The fuel injection system according to claim 11, wherein said switching valve unit has first and second chambers separated by sliding piston, said first chamber being connected to said fuel chamber and said second chamber being connected to said booster, said sliding piston having passages which connect said first chamber to a source of low pressure in said second state and each of said chambers to a source of low pressure in said third state.

13. The fuel injection system of claim 10, wherein said fuel line is connected to said common rail through a check valve connected in parallel with said booster.

* * * * *